US008985475B2

(12) United States Patent
Lacey

(10) Patent No.: US 8,985,475 B2
(45) **Date of Patent: *Mar. 24, 2015**

(54) LAUNDRY TRANSPORT AND PATHOGEN CONTAINMENT APPARATUS AND METHOD

(76) Inventor: Bertram E. Lacey, Frederick, MD (US)

( * ) Notice: Subject to any disclaimer, the term of this patent is extended or adjusted under 35 U.S.C. 154(b) by 433 days.

This patent is subject to a terminal disclaimer.

(21) Appl. No.: 13/406,526

(22) Filed: Feb. 27, 2012

(65) Prior Publication Data

US 2013/0055587 A1 Mar. 7, 2013

Related U.S. Application Data

(63) Continuation-in-part of application No. 12/357,459, filed on Jan. 22, 2009, now Pat. No. 8,123,141.

(51) Int. Cl.

| | |
|---|---|
| ***F24F 3/14*** | (2006.01) |
| ***F24F 7/08*** | (2006.01) |
| ***B65D 88/74*** | (2006.01) |
| ***B65D 90/00*** | (2006.01) |
| ***B65D 90/48*** | (2006.01) |

(52) U.S. Cl.

CPC ..... *B65D 88/745* (2013.01); *B65D 90/006* (2013.01); *B65D 90/48* (2013.01); *B65D 2590/0066* (2013.01)

USPC ..... 236/44 C; 236/49.3; 454/239; 34/218

(58) Field of Classification Search

USPC ..... 236/44 A, 44 C, 49.3; 454/239, 252; 62/78; 34/218

See application file for complete search history.

(56) References Cited

U.S. PATENT DOCUMENTS

| | | | | |
|---|---|---|---|---|
| 3,249,294 | A | 5/1966 | Hughes et al. | |
| 3,318,722 | A | 5/1967 | Ullman | |
| 3,656,542 | A | 4/1972 | Darm | |
| 5,337,581 | A | 8/1994 | Lott | |
| 5,590,830 | A * | 1/1997 | Kettler et al. | 236/49.3 |
| 7,000,798 | B2 | 2/2006 | Gruennert | |
| 7,310,969 | B2 | 12/2007 | Dale | |
| 2010/0180461 | A1 | 7/2010 | Lacey | |

* cited by examiner

*Primary Examiner* — Marc Norman
(74) *Attorney, Agent, or Firm* — Dale J. Ream

(57) ABSTRACT

A laundry transport apparatus and method includes a container defining an interior area configured to accommodate a plurality of laundry carts, the container having a door movable between closed and open configurations to selectively allow access to said interior area. The apparatus includes a ventilation network to pass air to and from the interior area, the ventilation network including a pathogen identification and containment apparatus to detect, isolate and treat potentially harmful material within the soiled laundry. At least a portion of intake and outlet ducts are immediately adjacent one another to influence temperature of air passing through each duct, warmer air passing through one of the intake duct or the outlet duct becoming cooler and cooler air passing through another of the intake duct or the outlet duct becoming warmer.

3 Claims, 7 Drawing Sheets

LAUNDRY TRANSPORT AND PATHOGEN CONTAINMENT APPARATUS AND METHOD

CROSS-REFERENCE TO RELATED APPLICATIONS

This application claims the benefit of non-provisional patent application Ser. No. 12/357,459, publication number US 2010/0180461 A1, filed 22 Jan. 2009, by the present inventor, and scheduled to issue as U.S. Pat. No. 8,123,141 on Feb. 28, 2012.

BACKGROUND OF THE INVENTION

This invention relates generally to laundry systems and, more particularly, to a method and apparatus for transporting laundry that increases the efficiency and lowers the cost of laundering textiles, as well as provides identification, containment, and treatment of potentially harmful material within the soiled laundry.

Linens are typically collected from commercial users during normal working hours from multiple workstations, such as from hospitals, nursing facilities, or industrial facilities. The soiled linens are usually placed into linen carts that remain in predetermined locations throughout the facility. The linen carts are retrieved upon arrival of the laundry truck from a laundry processing facility and weighted prior to loading onto the truck. This process is very inefficient and may lead to delays for both the cleaning staff and the launderers. Another problem frequently experienced in laundry processing is that linens may not be properly stored and thus may become degraded by environmental factors such as ultraviolet light, moisture, temperature, insects, and textile mold and mildew.

Various devices have been proposed in the art for transporting and laundering textiles. Although assumably effective for their intended purposes, the existing devices and methods are either inefficient, not cost effective, or fail to optimize the sanitation and freshness characteristics of the textiles being transported and laundered.

Therefore, it would be desirable to have an apparatus and method for transporting and laundering textiles that is efficient and cost-effective. Further, it would be desirable to have an apparatus and method for transporting and laundering textiles that provides a transportation apparatus that avoids degradation of stored linens from environmental factors. In addition, it would be desirable to have an apparatus and method for transporting and laundering textiles that provides security and insect control.

U.S. Pat. No. 7,310,969, titled "Controlled-Environment Cargo Container," issued to Robert Dale on Dec. 17, 2007, teaches an apparatus for controlling the environment of cargo through lateral ventilation, but, among other things, does not address ducts being adjacent or in a heat exchange relationship, or pathogen control system.

SUMMARY OF THE INVENTION

Therefore, a laundry transport apparatus and method according to the present invention includes a container defining an interior area configured to accommodate a plurality of laundry carts, the container having a door movable between closed and open configurations to selectively allow access to said interior area. The container is a trailer configured to be moved by a vehicle. The apparatus includes a ventilation network to pass air to and from the interior area, the ventilation network including an intake duct for channeling air to the interior area and an outlet duct for channeling air from the interior area. At least a portion of the intake and outlet ducts are immediately adjacent one another to influence temperature of air passing through each duct, warmer air passing through one of the intake duct or the outlet duct becoming cooler and cooler air passing through another of the intake duct or the outlet duct becoming warmer. The apparatus ventilation network may be coupled or coupleable to a pathogen system for detecting, containing, and treating potentially harmful pathogens, for example *Mycobacterium tuberculosis* (TB) and *Bacillus antracis* (anthrax).

Therefore, a general object of this invention is to provide an apparatus and method for transporting and storing laundry that avoids degradation of linens by environmental conditions. Another object of this invention is to provide an apparatus and method, as aforesaid, having a container that is climate controlled. Still another object of this invention is to provide an apparatus and method, as aforesaid, that increases the efficiency and cost-effectiveness of laundry transportation and storage services. Yet another object of this invention is to provide an apparatus and method, as aforesaid, in which the laundry transport container is a truck trailer that is movable between pickup, processing, and receiving facilities. A further object of this invention is to provide an apparatus and method, as aforesaid, in which the transport trailer maintains an internal air environment that is controlled by a processor and may be remotely monitored. A further objective of this invention is to provide an apparatus and method, as aforesaid, in which the internal air environment may be monitored, isolated, and treated to isolate infectious diseases or pathogens. Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A laundry transport apparatus and a method of transporting laundry will now be described in detail with reference to FIG.

Figure 8:
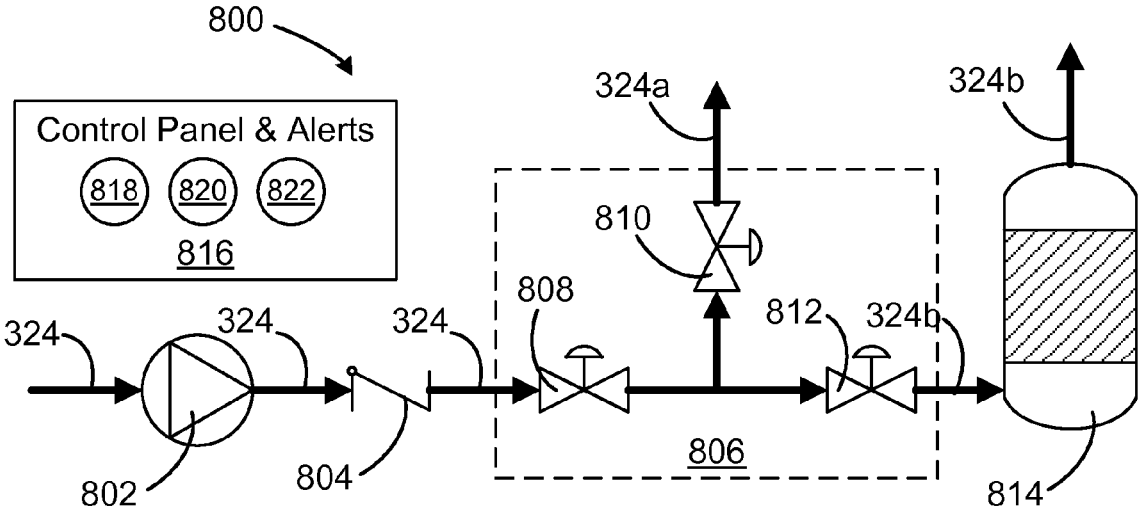
FIG. 8. is a schematic illustration of an exemplary pathogen system of an embodiment of the present invention.

1*a* through FIG. 8 of the accompanying drawings. More particularly, exemplary laundry transport apparatuses 100, 101, 102, and 103, which include a container 110.

Figure 1A:
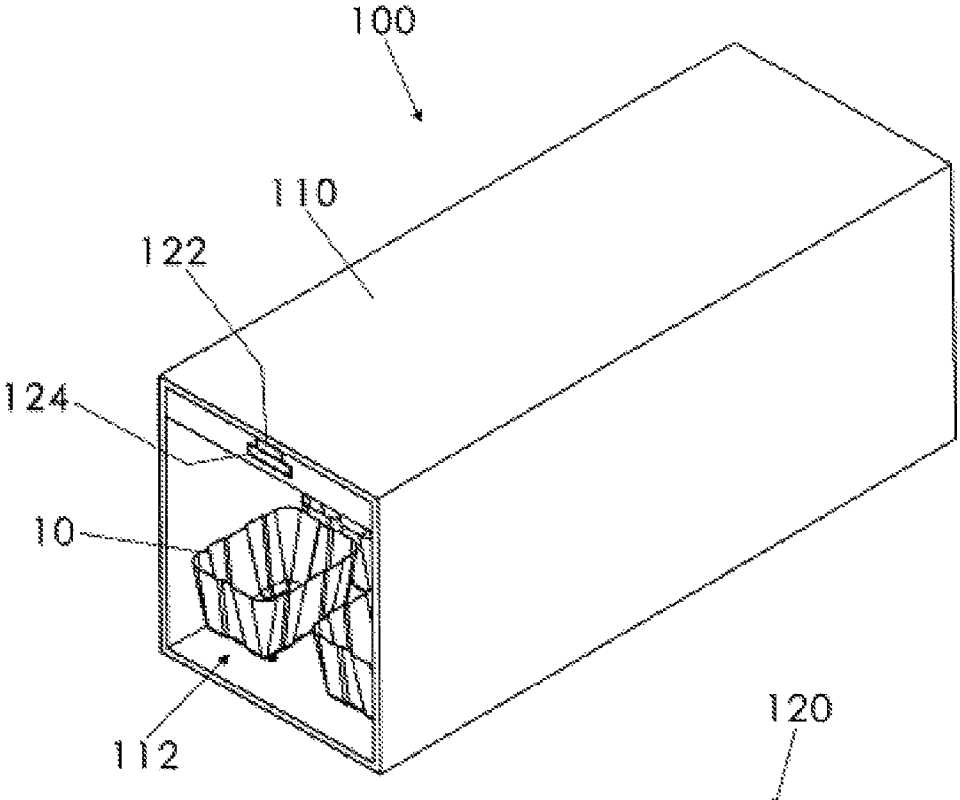
FIG. 1*a* is a perspective view of a laundry transport container according to a preferred embodiment of the present invention.

As shown in FIG. 1*a*, the container 110 defines an interior area 112 and has a door (not shown) for accessing the interior area 112. The door is movable between a closed configuration (not shown) and an open configuration (FIG. 1*a*) to selectively allow access to the interior area 112. The container 110 is configured to accommodate a plurality of laundry carts 10 in the interior area 112 (FIG. 1*a*). The container 110 may be a trailer configured to be moved by a vehicle (FIG. 1*a*) or may be otherwise mobile.

Figure 7:
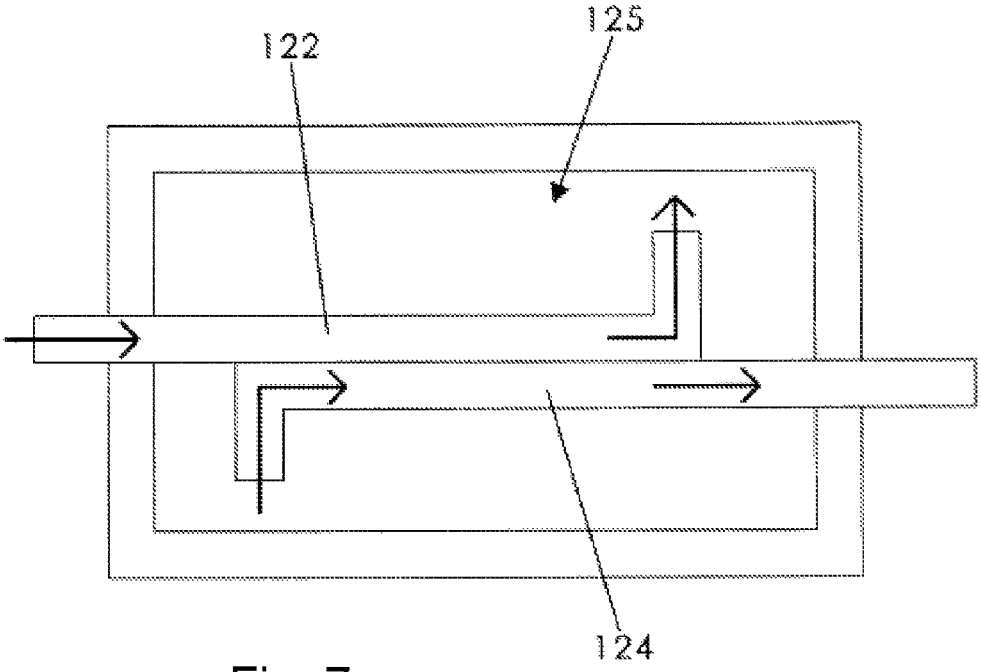
FIG. 7 is a schematic of a heat exchanger according to the present invention.

A ventilation network 120 is included to pass air to and from the interior area 112. The ventilation network 120 includes an intake duct 122 for channeling air 322 to the interior area 112 and an outlet duct 124 for channeling air 324 from the interior area 112. Apart from the ventilation network 120, the interior area 112 may be airtight when the door is at the closed configuration. One or more fan (not shown) may be configured (e.g., positioned and sized) to cause air to pass through the intake duct 122 and/or the outlet duct 124. To reduce or eliminate condensation, the intake and outlet ducts 122, 124 may form a heat exchanger 125. More particularly, at least a portion of the intake and outlet ducts 122, 124 are immediately adjacent one another to influence temperature of air passing through each duct 122, 124. Warmer air passing through one of the ducts 122, 124 becomes cooler from transferring energy to the cooler air passing through the other duct 122, 124, and the cooler air becomes warmer from obtaining the energy from the warmer air. FIG. 7 shows an exemplary heat exchange between an intake duct 122 and an outlet duct 124.

As shown in FIGS. 3 through 6, a climate controller 130 (e.g., a heater and air conditioner) may be included for selectively heating and cooling air 322 passing through the intake duct 122 after the air 322 is influenced by air 324 passing through the outlet duct 124 to cause the air 322 passing through the intake duct 122 to approximate a temperature of air in the interior area 112 separate from the ventilation network 120. Also shown in FIGS. 3 through 6, a dehumidifier 135 may be included for removing humidity from the air 322 passing through the intake duct 122 (e.g., after passing through the heat exchanger 125 and the climate controller 130).

Figure 1B:
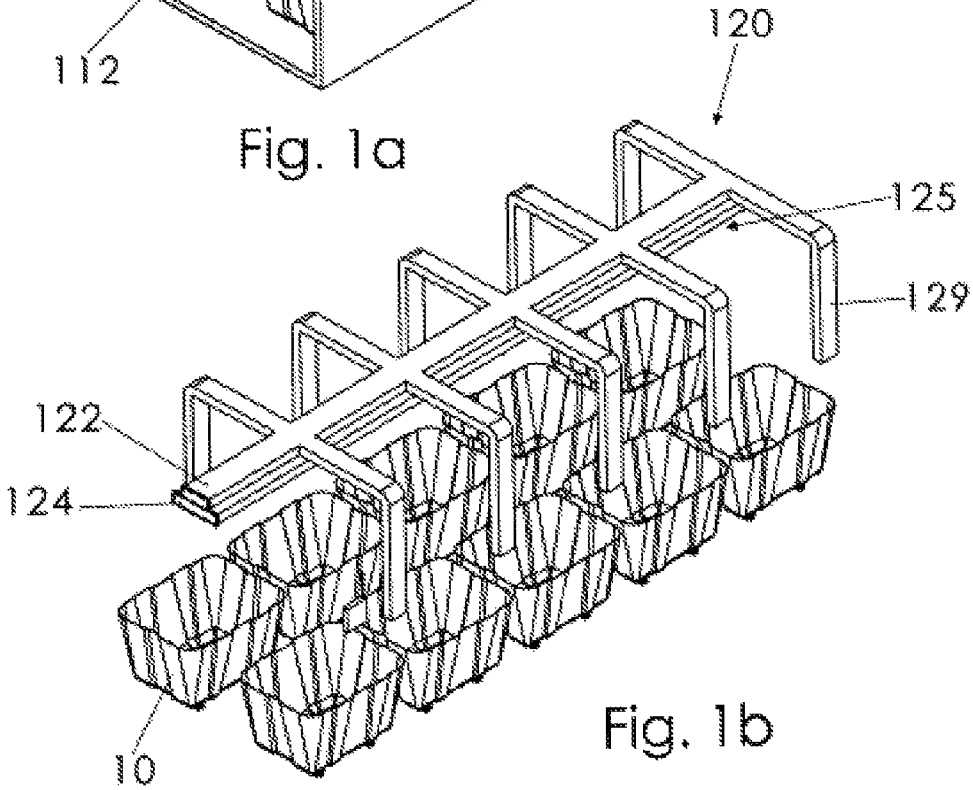
FIG. 1*b* is a perspective view of a ventilation network removed from the laundry transport container as in FIG. 1*a;*
Figure 3:
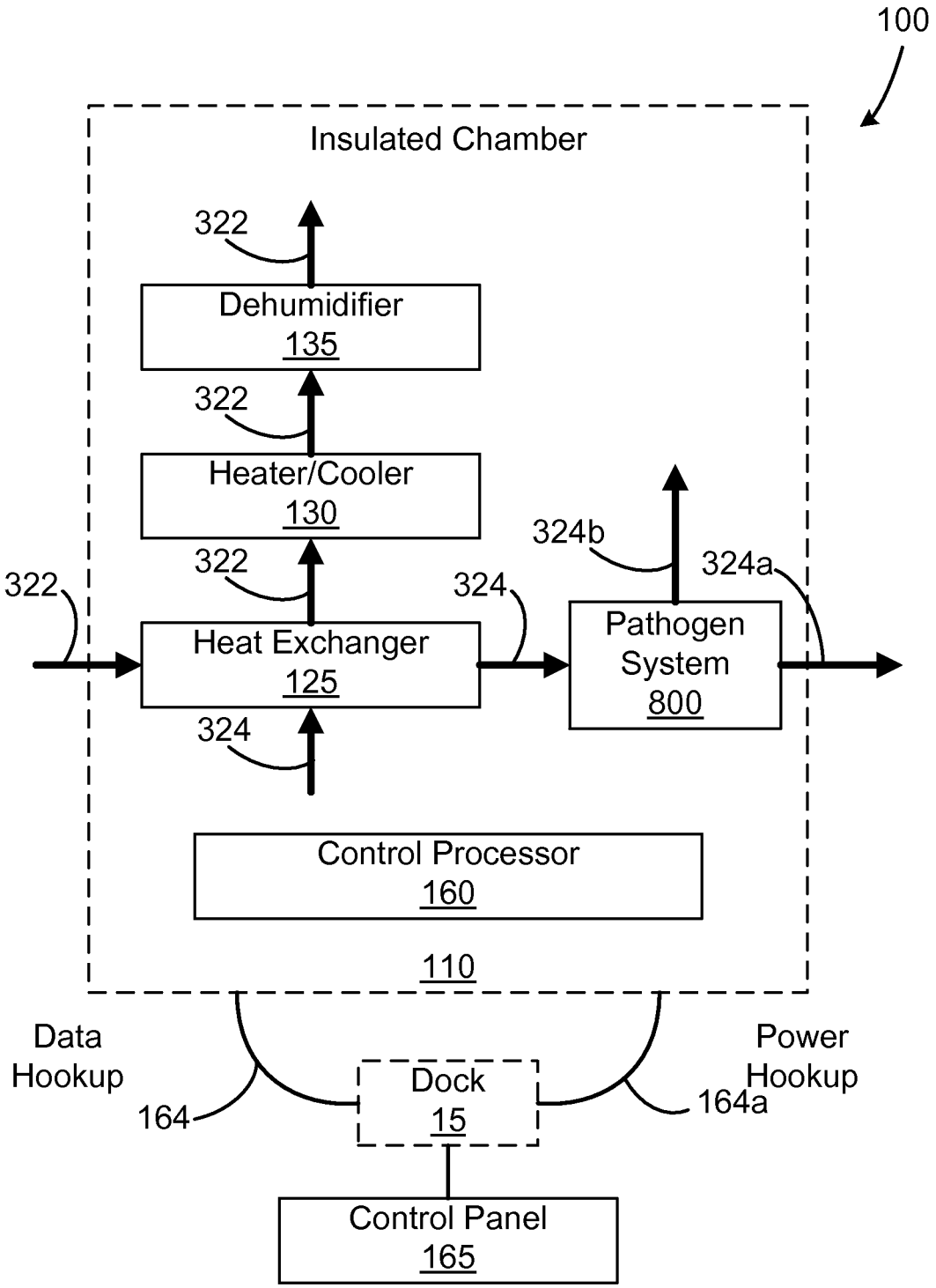
FIG. 3 is a block diagram of an exemplary laundry transport apparatus in engagement with a dock at a linen receiving area.
Figure 4:
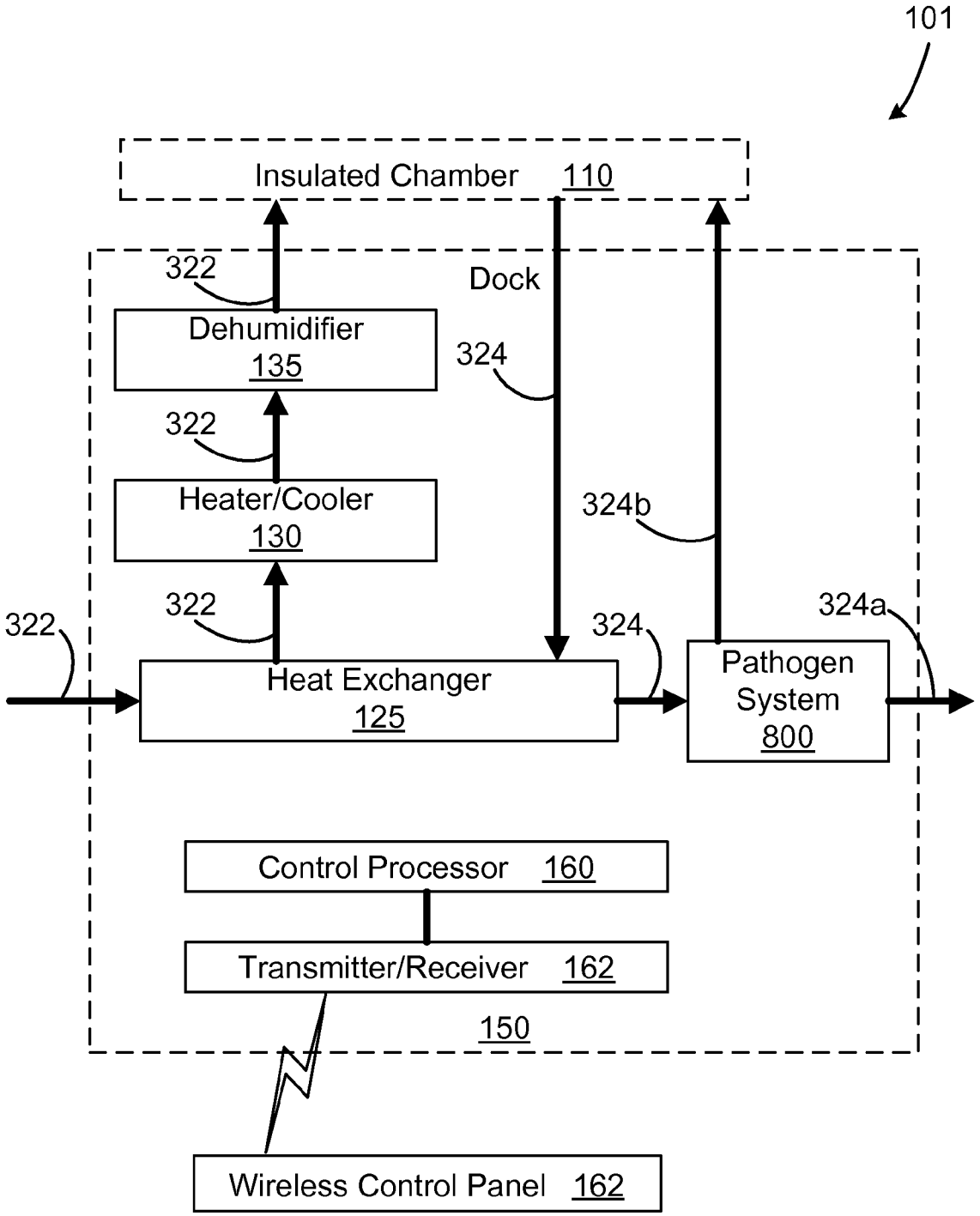
FIG. 4 is a block diagram of an exemplary laundry transport apparatus according to another embodiment of the present invention.
Figure 5:
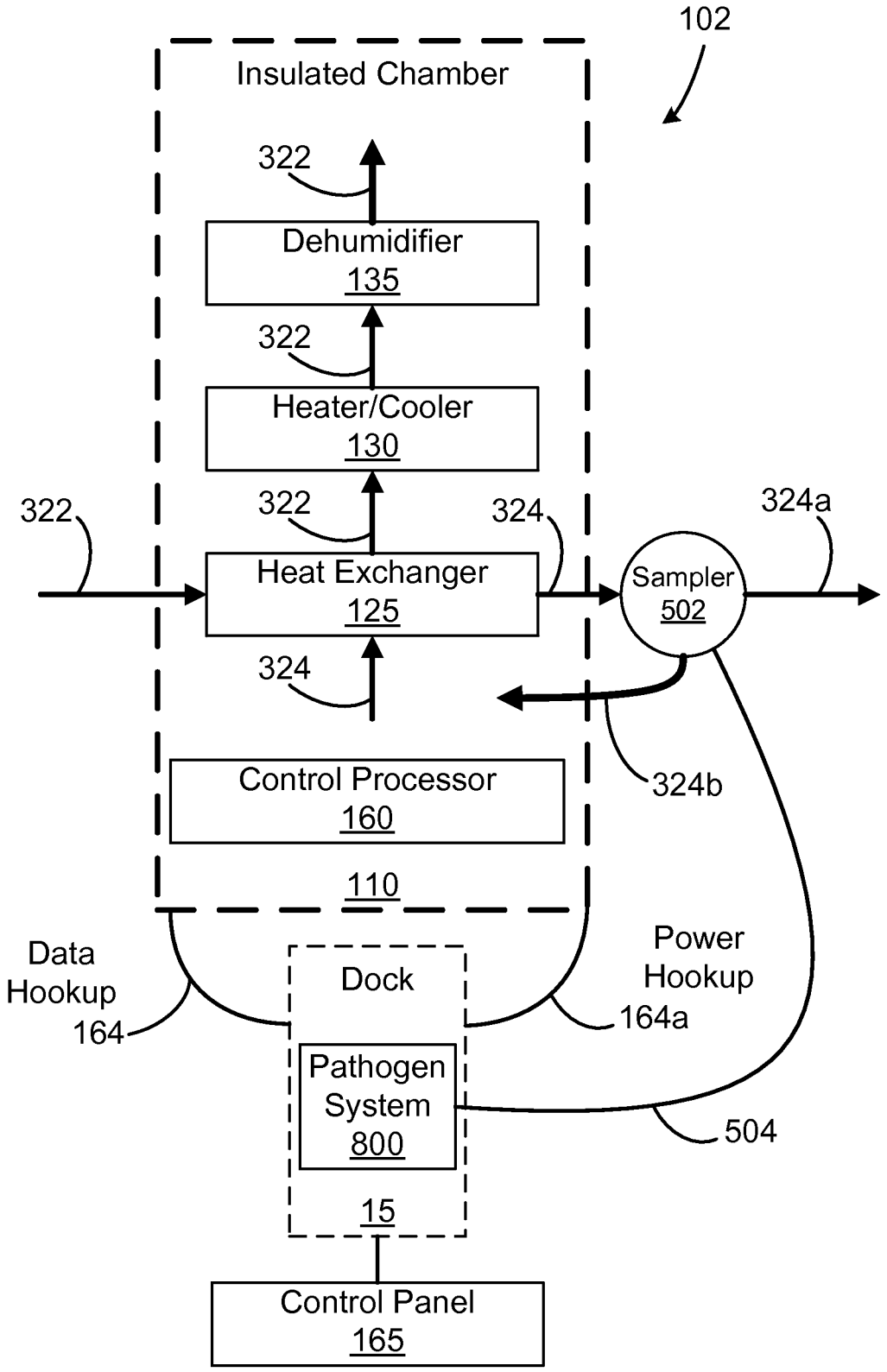
FIG. 5 is a block diagram of an exemplary laundry transport apparatus according to another embodiment of the present invention.
Figure 6:
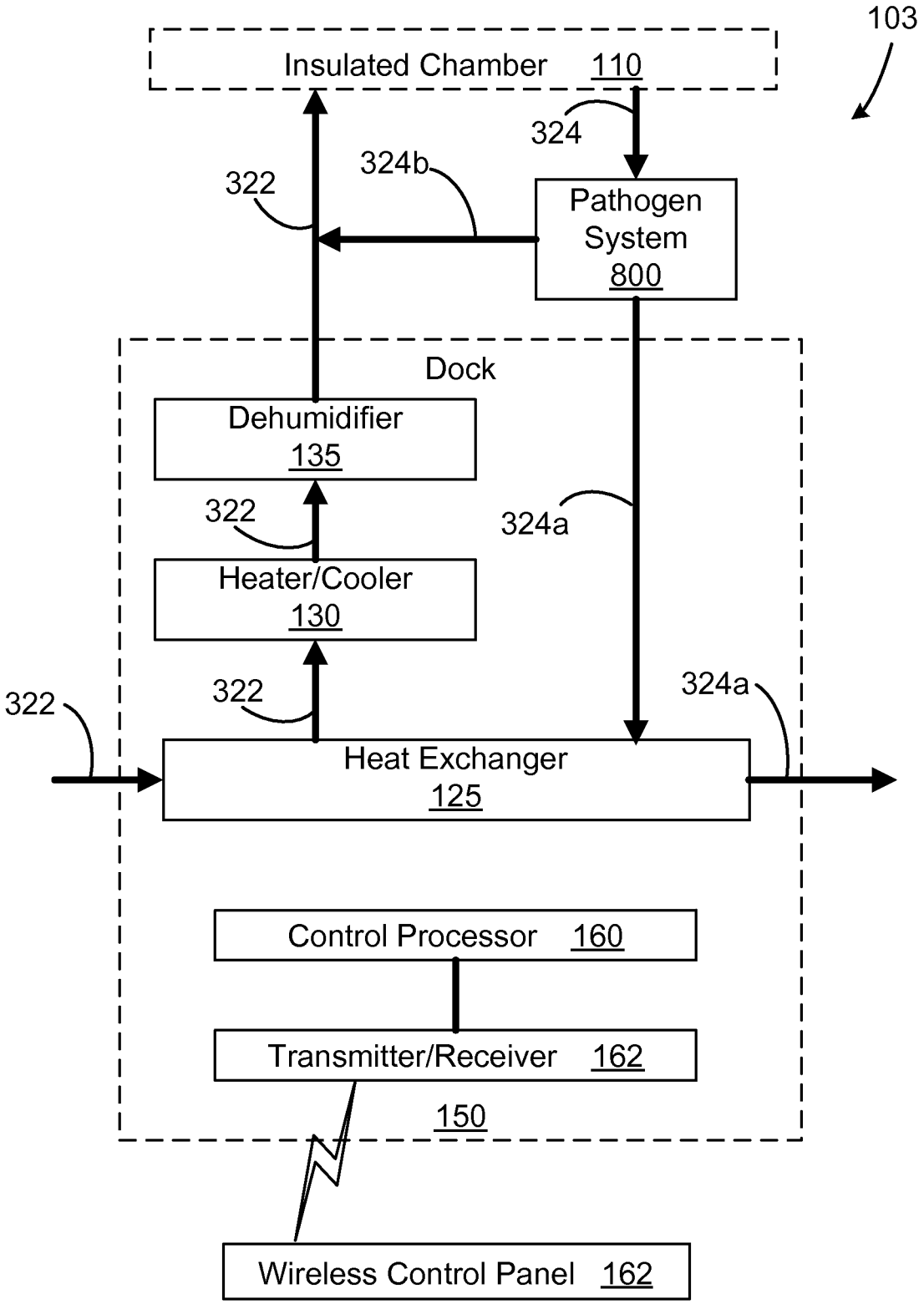
FIG. 6 is a block diagram of an exemplary laundry transport apparatus according to another embodiment of the present invention.

In some embodiments, as shown in FIGS. 1*b*, 3, and 5, the portions of the intake and outlet ducts 122, 124 immediately adjacent one another are operatively coupled to the container 110 (e.g., above where the carts 10 are accommodated, as shown in FIG. 1*b*). Branches 129 from the intake and/or outlet ducts 122, 124 may extend downwardly toward the carts 10 (FIG. 1*b*). The climate controller 130 and the dehumidifier 135 may also be operatively coupled to the container 110 (FIGS. 3 and 5). In other embodiments, as shown in FIGS. 4 and 6, a control unit dock 150 is separate from the container 110, and the portions of the intake and outlet ducts 122, 124 immediately adjacent one another are operatively coupled to the control unit dock 150. Similarly, the climate controller 130 and/or the dehumidifier 135 may be operative coupled to the control unit dock 150 (FIGS. 4 and 6). If the control unit dock 150 is included, a portion of the ventilation network is coupled to the container 110 and another portion of the ventilation network is coupled to the control unit dock 150. These portions of the ventilation network are in selective communication with each other to allow air to pass to and from the interior area 112. When not in communication with each other, the portion of the ventilation network coupled to the container 110 may be sealed. For example, a removable cover or a flexible gasket may be used.

The addition of pathogen system 800 may add various capacities to the transport apparatuses 100, 101, 102, and 103 (FIGS. 3 through 6), such as appropriate potentially harmful pathogen activities, which may include detection, identification, alert, containment, and remediation. In the exemplary embodiments, the pathogen system monitors the airflow 324 of outlet duct 124. Clear airflow 324*a* may be passed on to through the system 100, 101, 102, and 103, and ultimately released to the external environment. Suspect airflow 324*b* may be contained within the system 100, 101, 102, and 103, for appropriate subsequent action.

The pathogen system 800 may be configured in a variety of manners. In exemplary apparatus 100, the pathogen system 800 is operatively coupled to the container 110 (FIG. 3). In exemplary apparatus 101, the pathogen system 800 is operatively coupled to the dock 150 (FIG. 4). In exemplary apparatus 102, the pathogen system 800 is operatively coupled to the container 110 through sampler 502, which may include being fixedly coupled to the container 110, attachably coupled once arriving at the dock 15 (FIG. 5), among other potential configurations. In exemplary apparatus 103, the pathogen system 800 may be a stand-along module, operatively coupleable, as, either or both, warranted and desired by the operator, to the container 110 and the dock 150 (FIG. 6). A "stand-alone module," as used herein, means a grouping of components of the pathogen system 800 may be packaged into a system that can be individually transported to a use site. Such a "module" may still obtain power and communication connection from a transport apparatus, and still be considered "stand-alone." Additionally, a particular "stand-alone module" may comprise only parts of the pathogen system 800, where the other components may be separately deliverable to the use site, or operationally integrated into a particular transport apparatus embodiment.

In the transport apparatus 102, a sampler 502 is operatively coupled to the outlet airflow 324 and the pathogen system 800, through connection 504, to sample the airflow 324 for potentially harmful pathogens. The exemplary embodiment includes the capacity to suspend the release of suspect outlet airflow 324*b*, while permitting the release of clear airflow 324*a*.

In the case of transport apparatus 103, pathogen system 800 samples the airflow 324 before it enters the heat exchanger 125, so that only sampled clear airflow 324*a*, determined to be safe for release reaches the heat exchanger 125.

A processor 160 may be operatively coupled to the container 110 (FIGS. 3 and 5) or the control unit dock 150 (FIGS. 4 and 6) to store (e.g., using a memory device) and convey (e.g., through an output device) transport data, such as time data, temperature data, content data, etc. In conveying the transport data, a wireless data transfer system 162 (FIGS. 4 and 6) or a wired data transfer system 164 to a control panel 165 at the dock 15 (FIGS. 3 and 5) may be used. In exemplary embodiments of apparatuses 100 and 102, auxiliary power may be provided to components onboard the insulated container 110 through power hookup 164*a*.

In use, clean laundry is placed in the container 110 at a laundering facility and transported to its destination (e.g., a healthcare facility, etc.). The heat exchanger 125, climate controller 130, and dehumidifier 135 may maintain ventilation and acceptable humidity in the interior area 112 for the laundry during transport (FIGS. 3 and 5) and after being left at a dock (FIGS. 3 through 6). As such, the laundry may be transported further distances or simply housed in the container 110 for longer amounts of time than possible in prior art systems. Additionally, the pathogen system may provide for remediation of detected pathogens, or prophylactic treatment, en route.

In many applications, the way laundry is transported is very important. Healthcare facilities, for example, may be required to comply with the Joint Commission on Accreditation of Healthcare Organizations and infectious control guidelines. As should be readily appreciated, transporting or storing clean laundry in a manner that does not protect the laundry from moisture, undesirable temperatures, insects, textile mold, or mildew is not acceptable. Prior art methods and systems often make multiple trips to a single facility during working (i.e., business) hours to maintain the clean nature of the laundry and to collect soiled laundry.

In most prior art situations, the end user collects laundry during working hours from various workstations. Soiled laundry is placed into linen carts that remain in specified locations throughout the facility. The soiled linen carts are picked up upon arrival of a laundry truck from a processing plant and weighed prior to loading onto the laundry truck. This process can be very inefficient and can lead to delays for both the cleaning staff and the launderers.

Figure 2:
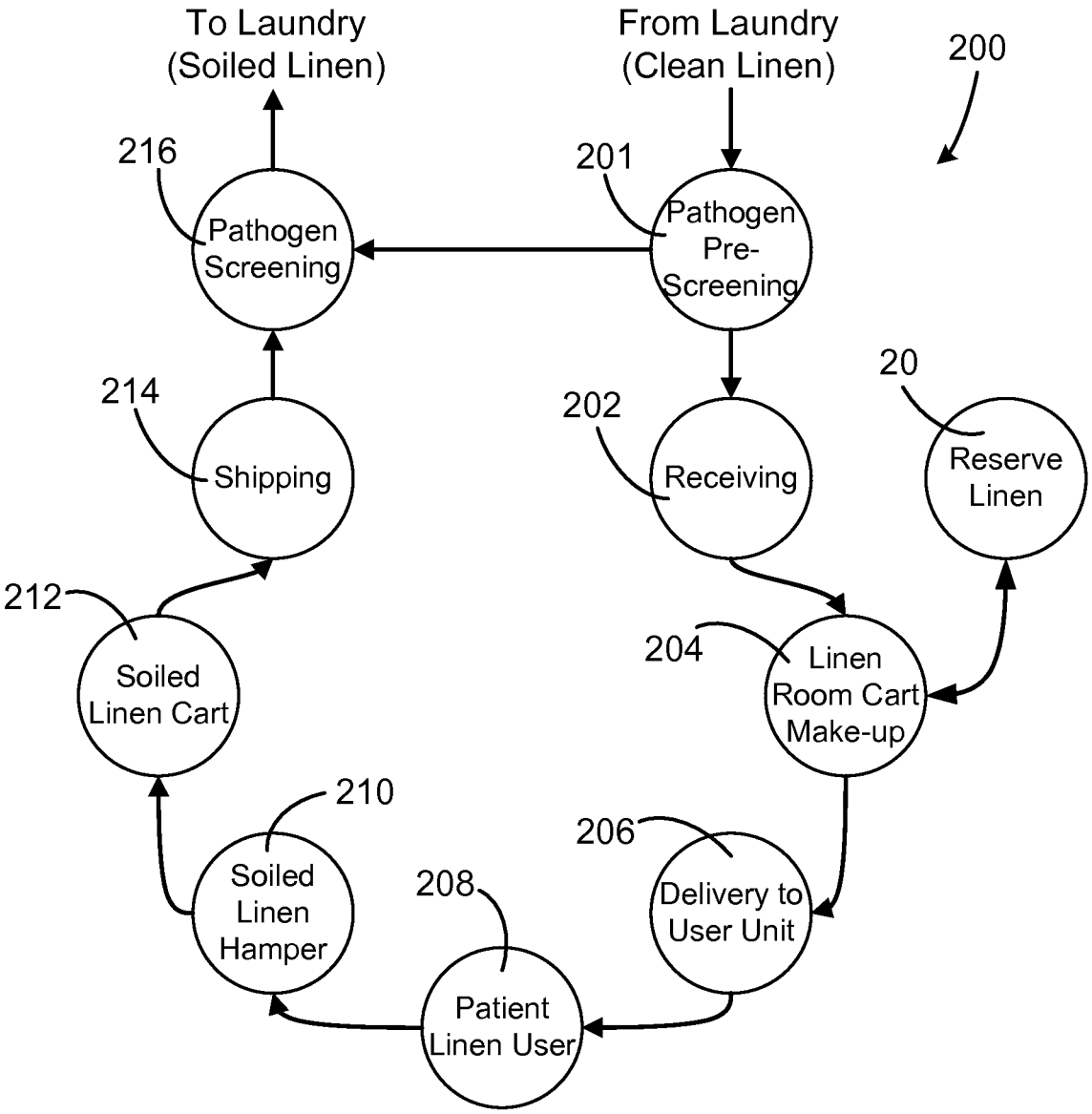
FIG. 2 is a flowchart illustrating a methodology for transporting, storage and pathogen monitoring of laundry according to the present invention.

FIG. 2 shows an improved system 200 for laundry transportation and storage that utilizes the laundry transport apparatus 100. At step 201, a pathogen system, of which the one shown in FIG. 8 is an example, may pre-screen the environment of the interior area 112 to determine if potentially harmful pathogens are present. The pathogen system 800 may have the capacity to provide notice of a potentially harmful contaminant, permitting an operator to curtail further transport activity in order to address the potential pathogen. System 200 illustrates a curtailed process where pre-screening 201 diverts that system to ongoing pathogen screening 216 and rerouting the cargo back to the laundry facility for further testing and proper remediation. During pre-screening 201 and further screening 216, the environment of interior area 112 is contained within container 110. Embodiments of the pathogen system 800 may be configured to treat particular pathogens within container 110.

At step 202, the container 110 housing clean laundry in the interior area 112 is moved (e.g., by a truck) to a loading dock and left at the loading dock. If the control unit 150 is not used (FIGS. 3 and 5), the container 110 may simply be left at the loading dock without further action, and the airflow and ventilation described above regarding FIGS. 3 and 5 may occur; if the control unit 150 is used (FIGS. 4 and 6), the container 110 may be placed in communication with the control unit 150 to allow airflow and ventilation described above regarding FIGS. 4 and 6. While omitting the control unit 150 may provide a more simple docking process, utilizing a control unit 150 may provide a cost savings, as each individual container 110 does not have to include various elements (as discussed above regarding FIGS. 4 and 6). Step 202 may occur during business hours or at night; the climate control provided inside the container 110 may allow the laundry to remain in the container 110 overnight without detriment. The processor 160 may be used to track the temperature in the container 110, humidity in the container 110, time the laundry was in the container 110, and/or any other information useful in determining whether the laundry has been compromised while in the container 110.

At step 204, the laundry is then moved into a linen (or "staging") room, where clean linen carts are configured using the laundry from the container 110 and laundry from a reserve linen area 20 if necessary. If not all laundry from the container 110 is needed for the carts, excess may be placed in the reserve linen area 20.

At step 206, the laundry in the clean linen carts is delivered to a unit for use, and the clean laundry is used at step 208. After being used, the laundry is placed in a soiled linen hamper at step 210, and laundry collected in the soiled linen hamper is moved to a linen cart at step 212. The soiled laundry from the soiled linen cart is collected, weighed, and moved to an empty container 110 at step 214 for transport to a laundering facility.

At step 216, the soiled laundry is screened for pathogens. If pathogens are found, the laundry may be treated en route. Otherwise, the laundry facility may be informed of the pathogen status upon arrival. Additionally, depending on the embodiment of the pathogen system, other desired alerts may be provided upon identifying a potential pathogen within the container 110.

Referring now to FIG. 8, an exemplary pathogen system 800 provides the interior chamber 110, of transport apparatuses 100, 101, 102, and 103, with the capacity to become a protective environment (PE) for airborne infection isolation (AII), as defined by the Center for Disease Control (CDC). The exemplary system 800 includes an appropriate pump 802, such as a negative pressure blower pump, to draw the outlet airflow 324 from the interior area 112. A check valve 804 may be added to ensure airflow 324 that enters the system 800 does not flow back into the interior area 112. Airflow 324 then enters a flow management system 806 for detecting, and safely segregating clear airflow 324*a* from suspect airflow 324*b*. The exemplary flow management system 806 may be a double block and bleed system, which employs a first sampling valve 808 to permit the inflow of the airflow 324, but contain such airflow 324 within the flow management system 806. Clear sampling valve 810 operates in conjunction with first valve 808 to route clear airflow 324*a* as chosen by the operator. Choices may include recirculation to the interior area 112, and release to the exterior atmosphere, among others. Suspect sampling valve 812 operates in conjunction with first valve 808 to route suspect airflow 324*b* as chosen by the operator. Choices may include routing to an appropriate sequestration apparatus 814, such as a knock-out tank, and a HEPA filter, among others, and even may include recirculation to the interior space 112, where the interior space 112 may be used as the appropriate containment device, and even the remediation environment.

An appropriate operator interface 816, such as a control panel and alerts 816, may include a variety of controls for the operator to set and adjust choices on managing the pathogen system 800. The control panel 816 may have a processor that effects the coordination of the first valve 808 with the clear valve 810 and the suspect valve 812 to receive signals from the sensors in the valves and effect the opening and closing of the proper valves to ensure appropriate controlled sequestration of clear airflow 324*a* from suspect airflow 324*b*. Appropriate controls and alerts may also include system and line pressure indicators 818, pathogen concentration indicators 820, and alarm state indicators 822.

The foregoing disclosure and description of the invention is illustrative and explanatory thereof. The present invention should only be limited by the following claims and their legal equivalents. The inventor trusts and relies on this legal principle, in order to avoid being unnecessarily repetitive and verbose. Various changes in the details of the illustrated construction may be made within the scope of the appended claims by one having ordinary skill in the art without departing from the spirit of the invention and scope of the claims.

Such changes expressly considered are other combinations, permutations, and arrangements of the elements contained within the apparatuses 100, 101, 102, and 103.

I claim:

1. A laundry transport apparatus, comprising:

a trailer having opposed front and rear ends, said container defining an opening at said front end and an interior area;

wherein said container includes a door at said container front end for selectively accessing said interior area, said door being movable between a closed configuration preventing access to said interior area and an open configurations giving access to said interior area;

a plurality of laundry carts removably positioned in said interior space, each laundry cart configured to hold laundry;

a ventilation network situated in said interior area and configured to pass air to and from said interior area, said ventilation network including:

an intake duct operatively coupled to a top wall of said trailer and extending longitudinally between said front and rear ends, said intake duct configured to channel air to said interior area;

an outlet duct immediately adjacent said intake duct and configured to channel air away from said interior area;

at least one fan configured to cause air to pass through said intake duct and said outlet duct;

wherein said interior area is airtight apart from said ventilation network when said door is at said closed configuration;

wherein intake and outlet ducts are immediately adjacent one another between said trailer front and rear ends to thereby form a heat exchange relationship so as to influence temperature of air passing through each said duct, warmer air passing through one of said intake duct or said outlet duct and thereby becoming cooler and cooler air passing through another of said intake duct or said outlet duct and thereby becoming warmer;

wherein said intake and outlet ducts include a plurality of branches extending outwardly and downwardly, each branch having a terminal end defining an opening positioned immediately adjacent a top of a respective laundry cart so as to ventilate said laundry in said respective laundry cart;

a climate controller for selectively heating and cooling air passing through said intake duct after said air is influenced by air passing through said outlet duct to cause said air passing through said intake duct to approximate a temperature of air in said interior area separate from said ventilation network;

a dehumidifier to selectively dehumidify air passing through said intake duct; and a pathogen system;

said pathogen system having a flow management system, for directing an airflow, operatively coupled to a pathogen control processor;

said pathogen control processor capable of controlling the flow management system to detect and isolate a portion of the airflow determined to be contaminated with potential pathogens, and selectively routing the contaminated portion of the airflow for isolation.

2. The laundry transport apparatus of claim 1, wherein the pathogen system has the capacity to perform pathogen remediation of the contaminated portion of the airflow.

3. The laundry transport apparatus of claim 1, wherein the pathogen system is a stand-alone module, operatively coupleable to the ventilation network.

* * * * *